US012312944B2

(12) United States Patent
Slaughter, Jr.

(10) Patent No.: US 12,312,944 B2
(45) Date of Patent: May 27, 2025

(54) FRETTING-WEAR RESISTANT BEACON LID

(71) Applicant: The Charles Machine Works, Inc., Perry, OK (US)

(72) Inventor: Greg L. Slaughter, Jr., Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 18/172,829

(22) Filed: Feb. 22, 2023

(65) Prior Publication Data

US 2023/0265756 A1 Aug. 24, 2023

Related U.S. Application Data

(60) Provisional application No. 63/312,943, filed on Feb. 23, 2022.

(51) Int. Cl.
*E21B 47/09* (2012.01)
*E21B 47/0228* (2012.01)

(52) U.S. Cl.
CPC ..... *E21B 47/09* (2013.01); *E21B 47/0228* (2020.05)

(58) Field of Classification Search
CPC ..... E21B 47/017; E21B 47/01
See application file for complete search history.

(56) References Cited

U.S. PATENT DOCUMENTS

| | | | | |
|---|---|---|---|---|
| 6,422,782 | B1 * | 7/2002 | Wentworth | E21B 7/046 175/45 |
| 7,121,363 | B2 * | 10/2006 | Michael | E21B 47/017 175/320 |
| 7,600,582 | B2 | 10/2009 | Wright, Jr. et al. | |
| 8,662,201 | B1 | 3/2014 | Wright, Jr. et al. | |
| 8,955,586 | B1 * | 2/2015 | Randa | E21B 47/0232 166/250.11 |
| 11,319,797 | B2 | 5/2022 | Morse et al. | |
| 2012/0118640 | A1 * | 5/2012 | Runquist | E21B 47/013 175/57 |
| 2014/0020953 | A1 * | 1/2014 | Chau | E21B 44/02 175/48 |
| 2014/0305709 | A1 * | 10/2014 | Slaughter, Jr. | E21B 7/046 175/76 |
| 2019/0078431 | A1 * | 3/2019 | Castrero | E21B 10/36 |

* cited by examiner

*Primary Examiner* — Tara Schimpf
*Assistant Examiner* — Ursula Lee Norris
(74) *Attorney, Agent, or Firm* — Tomlinson McKinstry, P.C.

(57) ABSTRACT

A connection system for a lid in a beacon housing. The lid is connected to the housing at a tab at a first end, after a lip of the lid is placed under a shelf at its second end. The tab has a cross-bore for receiving a connection pin through both the cross-bore and corresponding holes in the housing which form a continuous passage. The lid is placed under tension to reduce relative vibration between the lid and the housing. A set screw is placed within the tab to place a force on the connection pin. Further set screws are distributed about the lid and place the lid in tension relative to the housing. The lid can be removed by reducing the tension provided by the set screws, removing the connection pin, and adjusting the lid such that it is no longer under the shelf of the housing.

16 Claims, 8 Drawing Sheets

FRETTING-WEAR RESISTANT BEACON LID

SUMMARY

The present invention is directed to an assembly. The assembly comprises a beacon, an elongate housing and a lid. The beacon is configured to emit a dipole magnetic field. The elongate housing extends from a first to a second end, and has an exterior surface within which a cavity is formed. The cavity receives the beacon and has an open mouth that joins the exterior surface of the housing. The lid is configured to close the mouth of the cavity. The lid comprises a tab defining a first and second bore. The first bore is non-parallel to and intersects the second bore. The elongate housing defines a pair of aligned bores, wherein the first bore of the tab forms a continuous passage with the pair of aligned bores when the lid is covering the mouth of the cavity.

In another aspect the invention is directed to a method of joining a lid to a housing. The housing has an open mouth exposing a cavity. The method comprises placing the lid over the open mouth, placing a pin through a first aperture in the housing, a first bore in the lid, and a second aperture in the housing, placing a set screw within a second bore in the lid, and placing a force on the pin with the set screw. The first bore, first aperture, and second aperture form a continuous passage when the lid is placed over the open mouth. The second bore is non-parallel to and intersecting with the first bore.

In another aspect the invention is directed to a method. The method comprises placing a beacon into a cavity in an elongate housing through an open mouth, covering the open mouth with a lid, securing the lid to the elongate housing with a component, and thereafter, placing a set screw into the lid such that placement of the set screw applies a force to the component.

BRIEF DESCRIPTION OF THE DRAWINGS

FIG. 3 is a partially cross-sectional side view, with the upper half of the figure shown in section such that the cavity for placement of the beacon is shown with the lid on.

DETAILED DESCRIPTION

Figure 1:
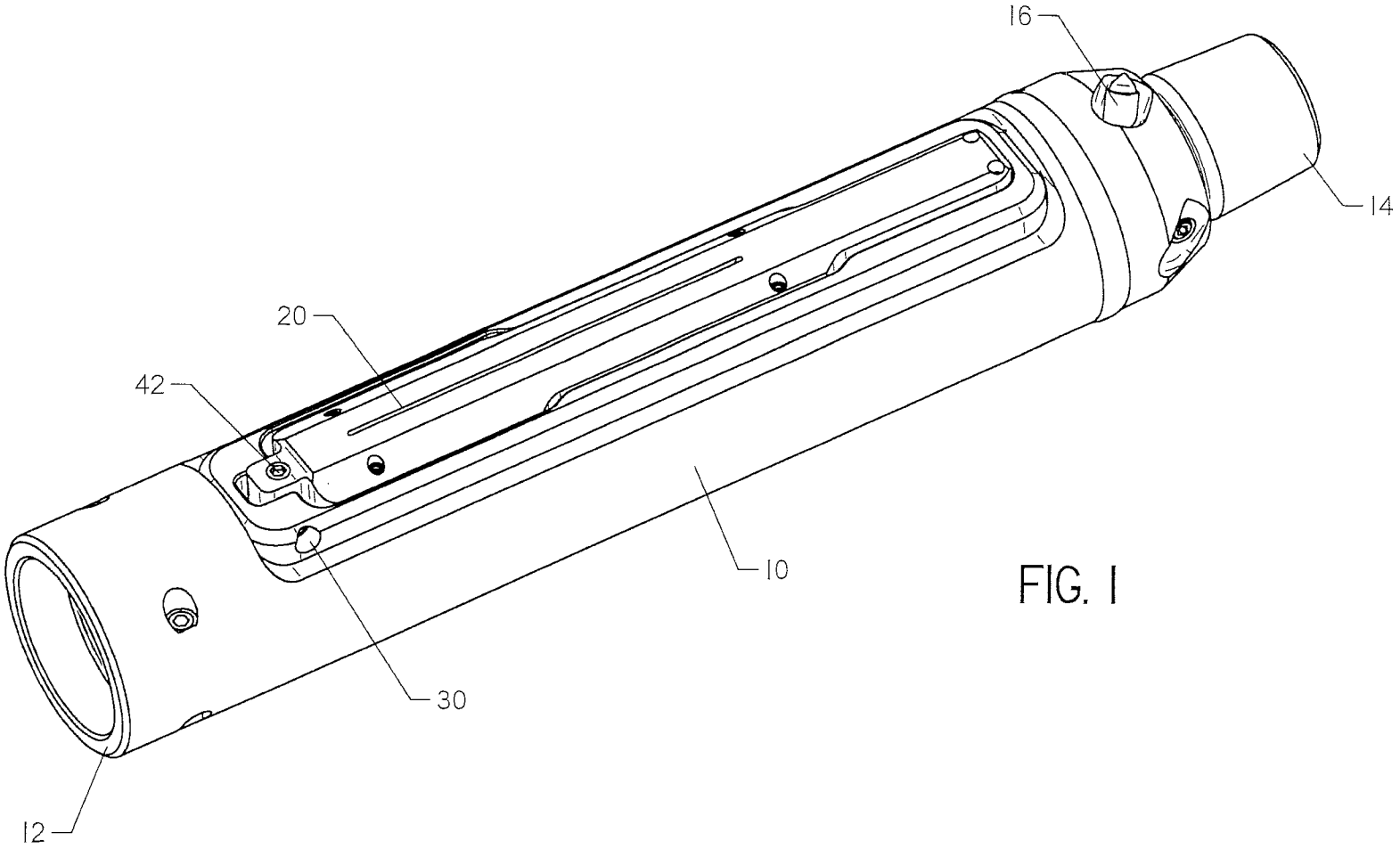
FIG. 1 is a top side view of a beacon housing with a lid attached thereto, in accordance with the present invention.

In horizontal directional drilling ("HDD") applications, a transmitter may be placed near a boring tool. Electromagnetic signals sent from the transmitter may be received at an above ground location to allow the path of the boring tool to be tracked and mapped. Typically, the transmitter is placed in a subassembly and protected from the underground environment. This subassembly is often called a "beacon housing."

A typical beacon housing will allow the beacon to be placed such that electromagnetic tracking signals can be sent, but provides enough space for the operation of the boring tool to continue unabated. As a result, the beacon is often placed away from the centerline of a beacon housing, allowing more space for mechanical components such as drilling rods, or space for drilling fluid to be transmitted to the boring tool. As a result of this activity, and the boring activity itself, the beacon housing is subject to significant movement and vibration.

Small amplitude wear between a below-ground beacon housing and the lid through which a beacon is installed into that housing, may cause wear to the lid. This wear, referred to herein as "fretting", also results in components, such as bolts and other fasteners used to retain the lid, to loosen and wear as well, amplifying the problem as the apparatus is used.

The apparatus described herein places one or more adjustable screws along the length of the beacon housing lid to remove the slack from the system. By pre-loading the components, relative vibration is minimized and fretting wear reduced.

In current beacon housings, a lip is utilized to provide retention at one end, with a bolt or other fastener at the other. The current invention utilizes set screws, as shown in the figures, to place these components in shear and compression, while putting the set screws in compression as well, which avoids the need to remove the screws.

Turning now to the figures, a beacon housing 10 is shown therein. The beacon housing 10 extends from a first end 12 to a second end 14. Formed thereon, and extending between the first 12 and second 14 ends, is a housing lid 20. The housing lid 20 is adapted to cover a cavity 18 formed in the beacon housing 10, in which a beacon may be placed. One or more cutting teeth 16 may be disposed near the second, or downhole end 14.

Figure 2:
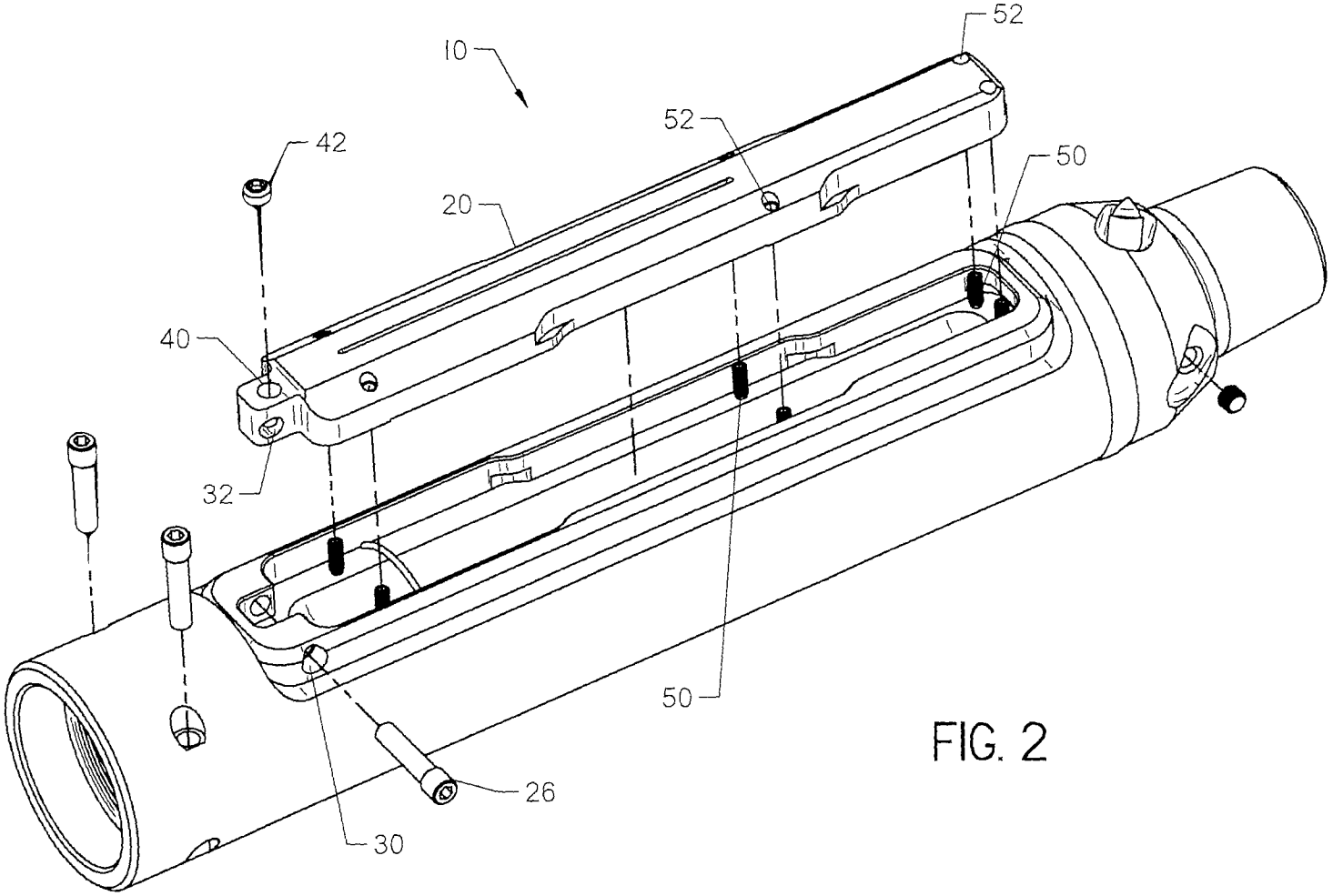
FIG. 2 is an exploded view of the beacon housing of FIG. 1.
Figure 3:
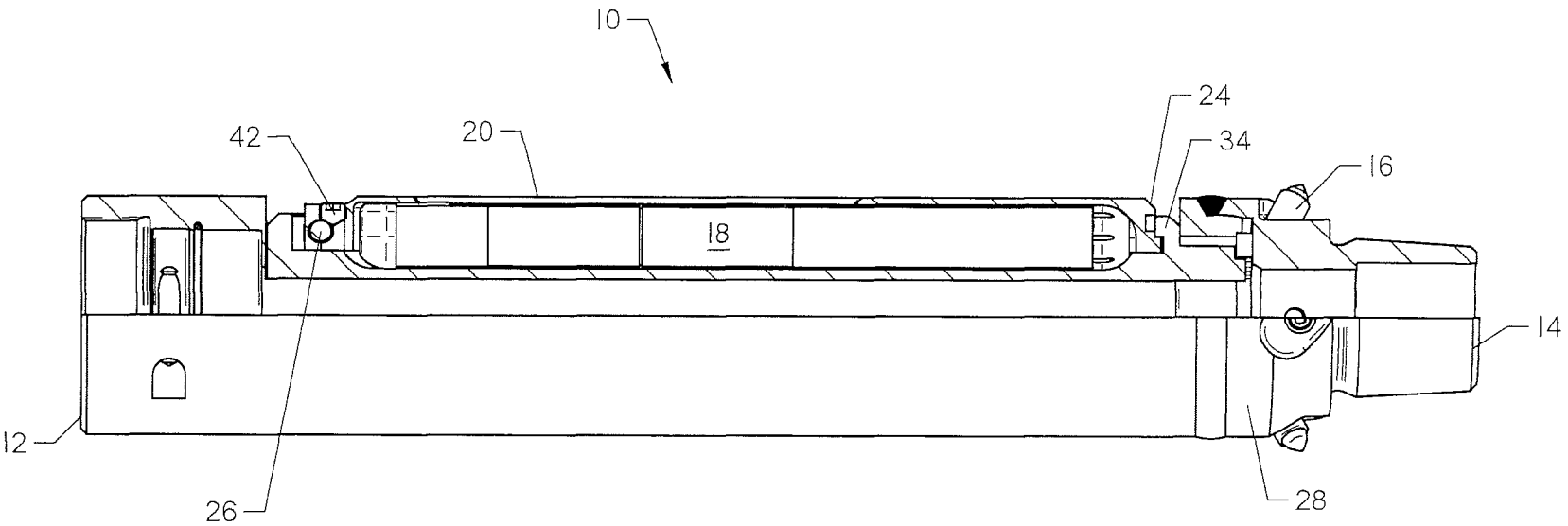
Figure 4:
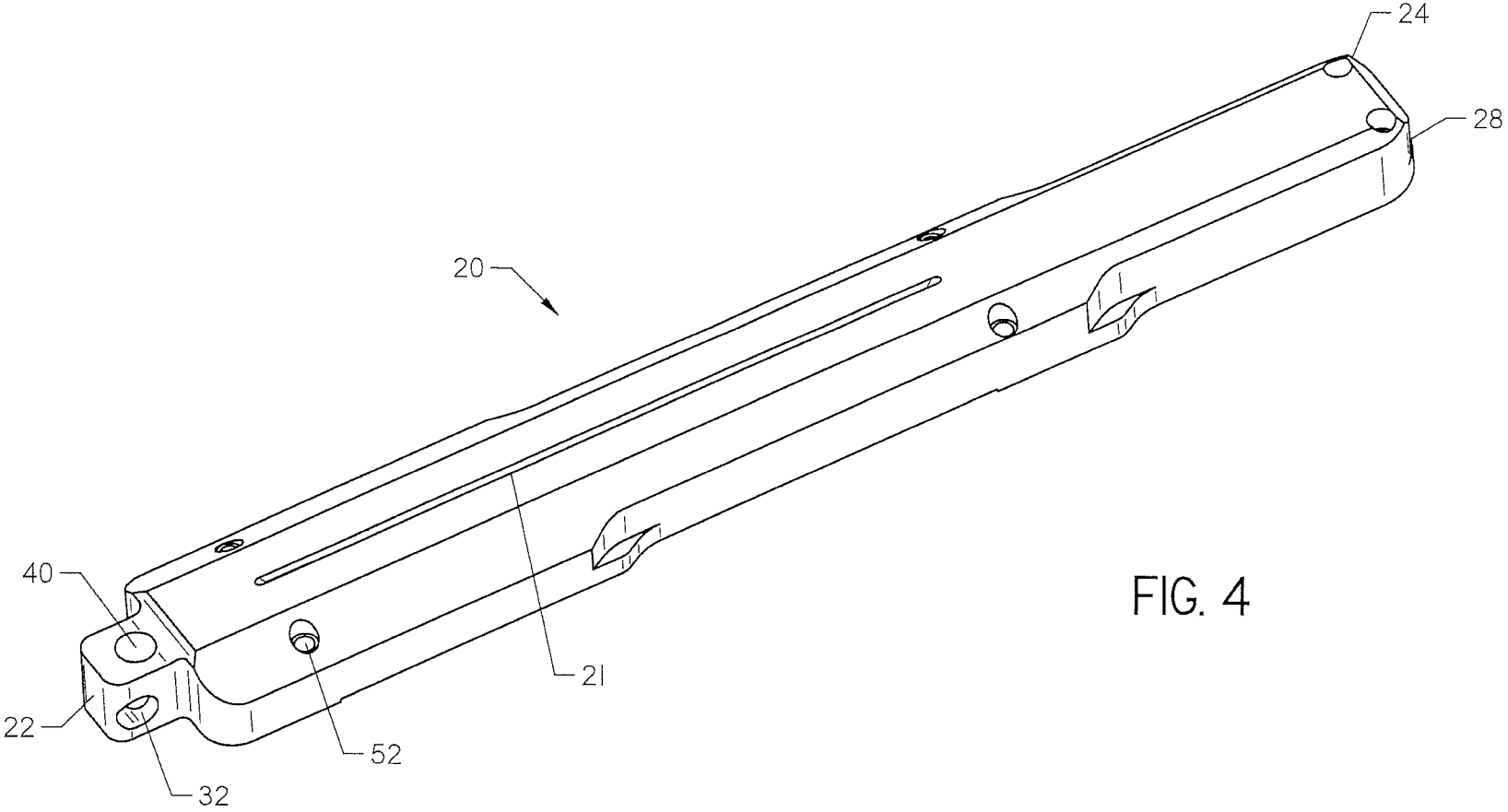
FIG. 4 is a top side perspective view of the lid for use with the beacon housing of FIG. 1.
Figure 5:
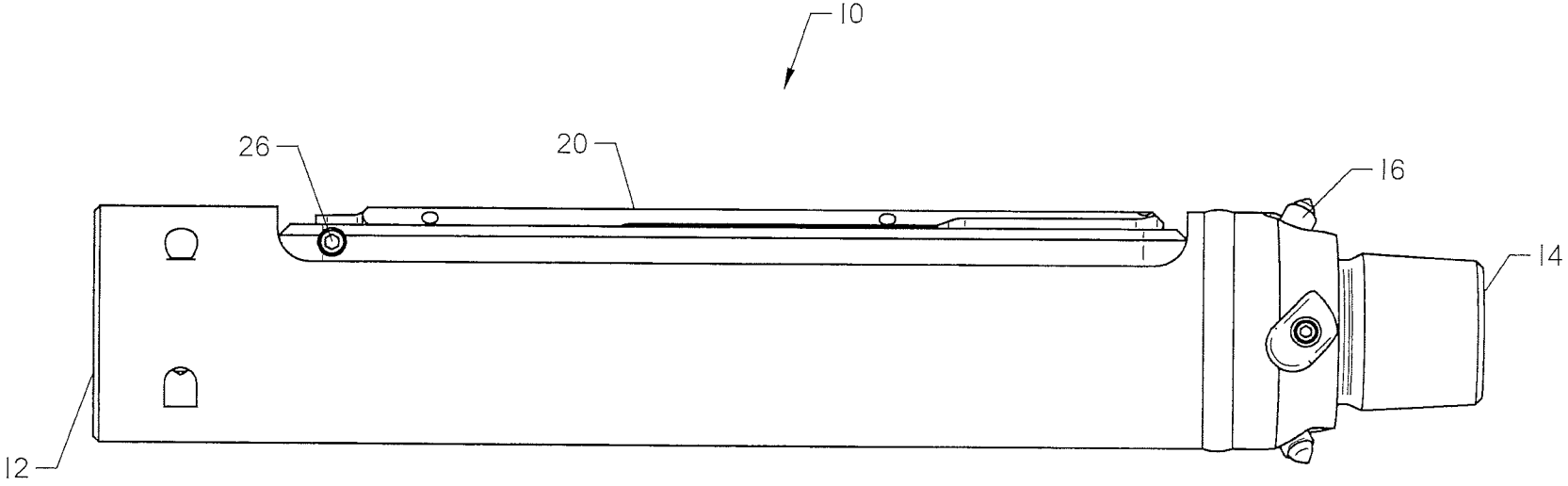
FIG. 5 is a side plan view of the beacon housing.
Figure 6:
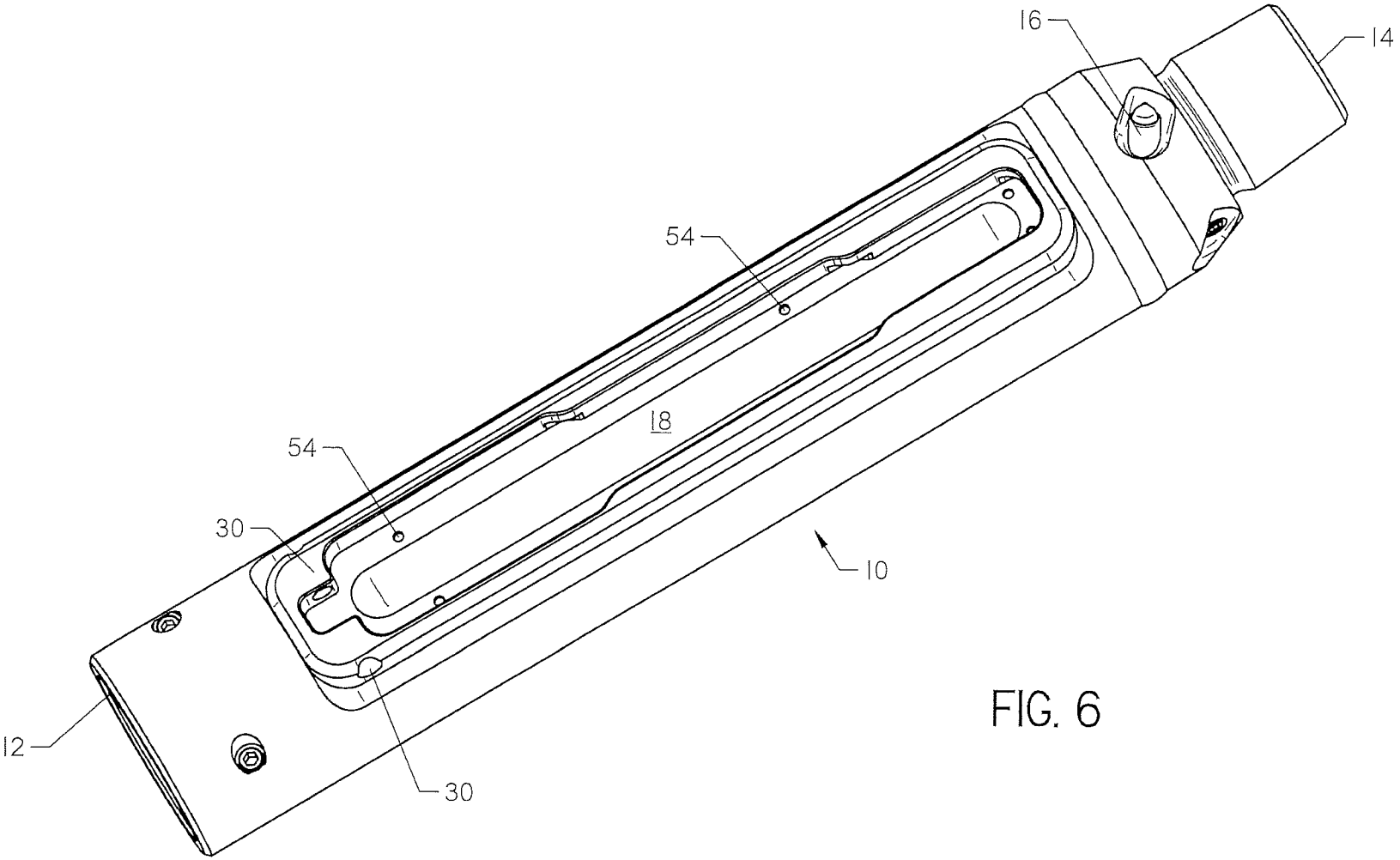
FIG. 6 is a top view of the beacon housing with the lid removed and components at the bottom of the cavity shown.
Figure 8:
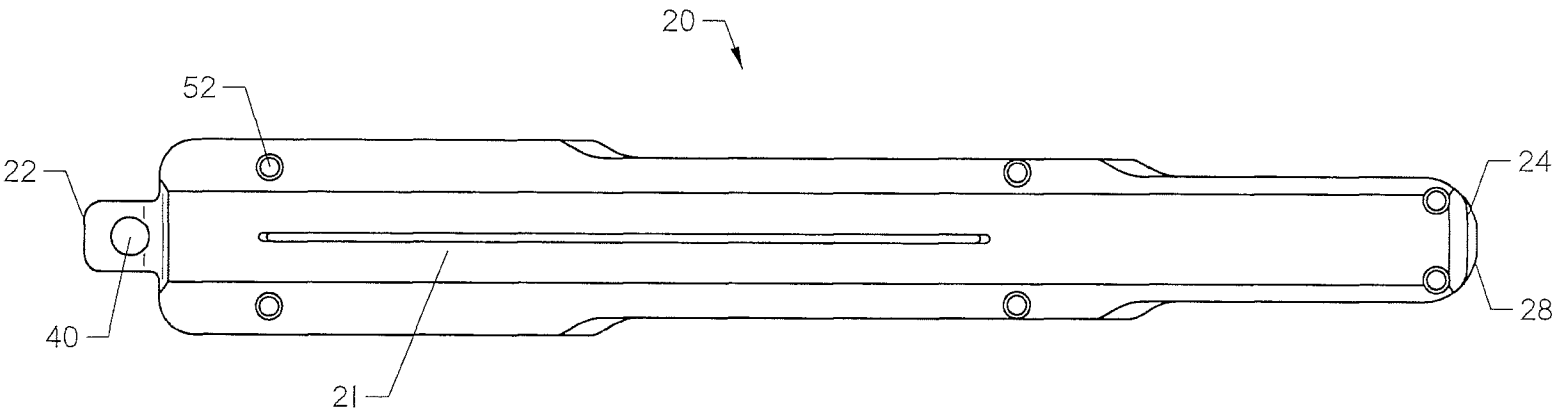
FIG. 8 is a top view of the lid shown in FIG. 4.

The lid, as best shown in FIGS. 2, 4 and 8, extends from a first end 22 to a second end 24. As shown, the lid 20 contains a narrow longitudinal slot 21 which promotes the transmission of an electromagnetic signal from the beacon to an above ground location with minimal impact on structural integrity of the beacon housing 10.

At the first end 22, a cross pin 26 or connection pin is placed through an aperture 30 in the housing 10 and an aperture 32 in the lid 20 to retain the lid 20 over the beacon cavity 18. The aperture 32 and aperture 30 together form a cross hole, whereby the cross pin 26, when fitted through the cross hole, prevents removal of the lid 20.

A top hole 40 is disposed at the second end 22 of the lid 20. The top hole 40 intersects the aperture 30 in the lid. A set screw 42 may be placed within the top hole 40 to apply a force to the cross pin 26. The cross pin 26 may be a caliper bolt, heavy duty coil pin, or normal bolt, and is the only part required to be completely removed in order to detach the lid 20 from the housing 10.

The set screw 42 may have a conical nose or another shape of nose configured for application of wedging forces to the cross pin 26. The set screw 42 contacts the cross pin 26 at an angle, removing slack which may exist in the interface between the cross pin 26 and the lid 20. Removing the slack reduces or eliminates fretting wear due to metal-to-metal vibration contact and prevents the cross pin 26 from backing out of the apertures 30, 32.

At the second end 24 a lip 28 may be placed below an overhanging shelf 34 on the housing 10 to provide retention. When installing the lid 20, the lip 28 is placed under the shelf 34, then the first end 22 is positioned such that the apertures 30, 32 are aligned, allowing placement of the cross pin 26.

Likewise, removing the cross pin 26 allows the first end 22 of the lid 20 to be pulled away from the housing 10, and the lip 28 then pulled from under the shelf 34. In order to remove the cross pin 26, and thus the lid 20, the set screw 42 need only be loosened to remove the tension on the cross pin, not removed entirely.

Figure 7A:
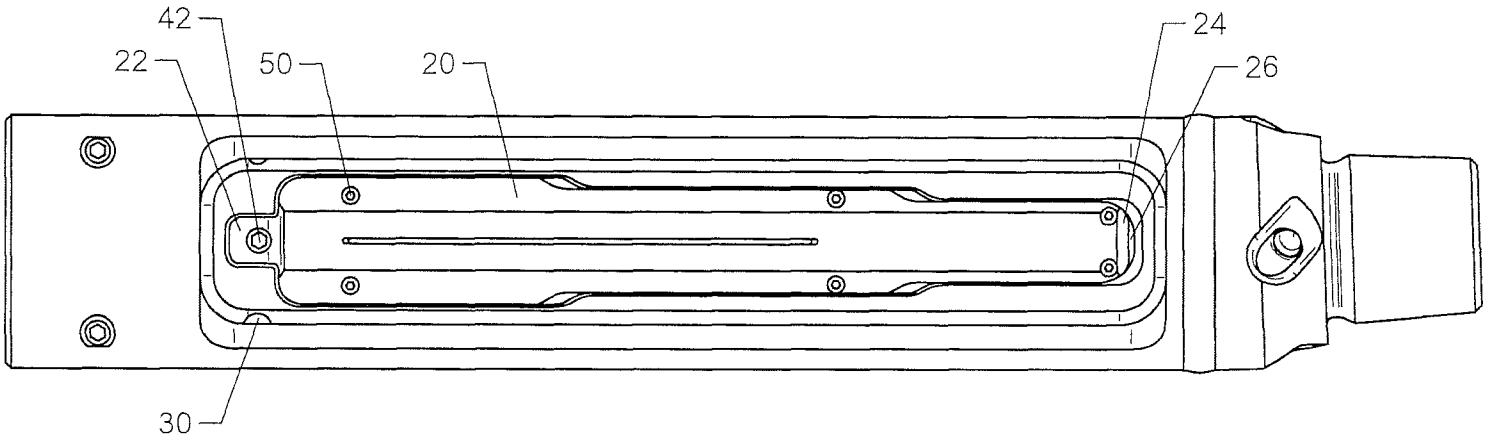
FIG. 7A is a top view of the beacon housing with the lid in a first position.
Figure 7B:
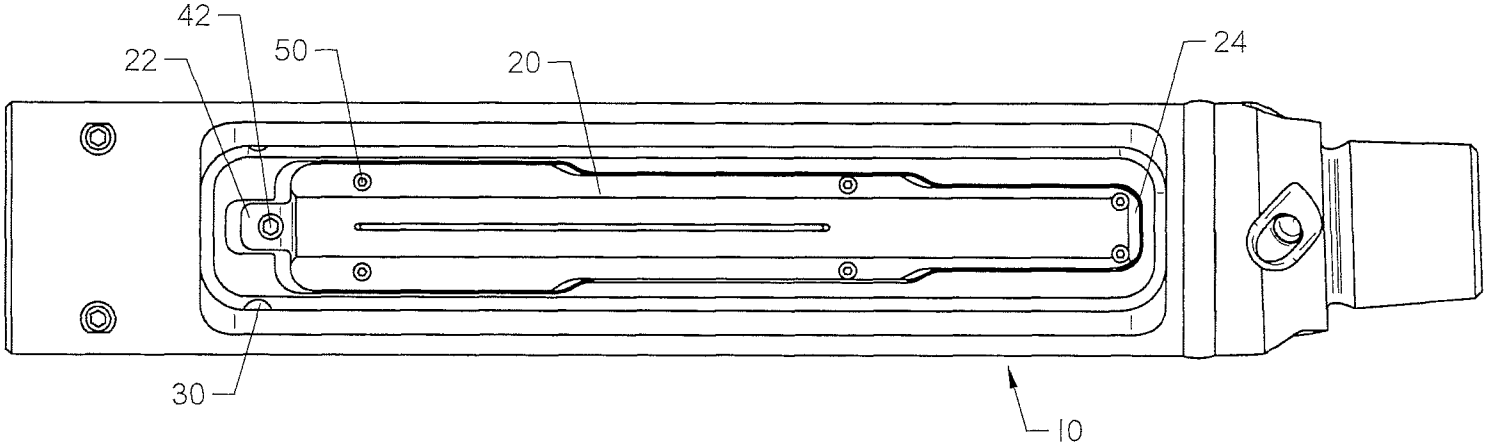
FIG. 7B is a top view of the beacon housing with the led in a second position.

FIGS. 7A and 7B show the lid being removed without removing set screw 42. In FIG. 7B, the lid 20 is positioned in a second position, ready for connection to the housing 10 through the use of the cross pin 26. However, as the cross pin 26 has been removed due to loosening of the set screw 42, the lid 20 can be moved into a first position as shown in FIG. 7A. The second end 24 may then be tilted away from the housing 10 and removed, allowing access to the cavity 18.

The apparatus further comprises a plurality of lid set screws 50. Each lid set screw 50 engages with a hole 52. The lid set screws 50 are configured to engage against the housing 10 at various contact points, pushing the lid 20 away from the housing 10. When the set screws 50 press against the housing 10, pressure is applied to the lip 28 and the cross pin 26, further protecting against fretting. In addition, these lid set screws 50 may engage with contact points such as depressions 54 formed in the housing 10 at the location where they engage, providing a locking mechanism. The set screws 50 may be loosened when the lid 20 is removed, as shown in FIGS. 7A and 7B.

Thus, the set screw 42 and lid set screws 50 have two general configurations. In the first configuration, the set screw 42 places a force on the cross-pin 26 and the lid set screws 50 extend to contact the housing at a contact point. This configuration places the lid 20 in tension as it is covering the cavity 18. The cross-pin 26 is subjected to a shear force preventing its removal and the lid 20 itself is in tension due to the set screws 50 causing a force at the cross-pin 26 and the interface between the lip 28 and shelf 34.

In a second configuration, the set screw 42 and lid set screws 50 do not apply a force—they are "loosened" from the first configuration. In this second configuration, the cross-pin 26 can be removed as desired, allowing the lid 20 to be adjusted such that the lip 28 is no longer under the shelf 34 of the housing, allowing removal of the lid 20 without the actual removal of any set screw.

Alternatively, or in addition to the set screws 42, 50 used herein, a set screw may be placed at the second end 24 of the lid 20 to engage with lands formed in the housing 10 near the lip 28. When set, such a set screw may provide force to cause the lid 20 to pop up when the cross pin 26 is removed, or may adjust the pressure between the lid 20 and housing 10 when the cross pin 26 is installed.

Finally, another alternative may involve set screws being used against a surface of the lid 20, either at the first end 22 or second end 24 (or both), to reduce front-rear movement of the lid relative to the housing 10. This orientation may be used alone or in combination with other elements disclosed herein. Preferably, the set screw 42 would be used with such a length-wise set screw arrangement.

Likewise, set screws may be used along the side of the lid, pushing the lid to one side and limiting movement in the same way. In this embodiment, the lid 20 has sideways play when placed above the cavity 18. In one orientation, the lid may be placed such that it can be removed, but when moved to the side, it becomes locked in place. When this side-to-side play is removed (to decrease fretting), the lid may also be secured such that it remains placed over the cavity during operation.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

The invention claimed is:

1. An assembly comprising:

a beacon configured to emit a dipole magnetic field;

an elongate housing extending from a first end to a second end, and having an exterior surface within which a cavity is formed, the cavity receiving the beacon and having an open mouth that joins the exterior surface of the housing; and a lid configured to close the mouth of the cavity, and comprising:

a tab defining a first bore and a second bore, wherein:

the first bore is non-parallel to and intersects the second bore;

wherein the elongate housing defines a pair of aligned bores, wherein the first bore of the tab forms a continuous passage with the pair of aligned bores when the lid is covering the mouth of the cavity;

a pin configured to be placed within the continuous passage formed by the first bore and the pair of aligned bores; and a set screw configured for placement within the second bore and comprising a conical end, wherein the conical end abuts the pin when the set screw is within the second bore and the pin is within the first bore.

2. The assembly of claim 1 in which the second bore is bound by a surface comprising threads.

3. The assembly of claim 1 wherein the set screw is characterized as a first set screw and further comprising:

a plurality of second set screws disposed about a perimeter of the lid and extending therethrough, wherein:

a first end of each of the plurality of second set screws is disposed on a first side of the lid and comprises a contact point, and a second end of each of the plurality of second set screws is disposed on a second side of the lid and comprises an adjustment point.

4. The assembly of claim 3, wherein the lid is disposed over the open mouth and the contact point of each of the plurality of second set screws engages the housing.

5. The assembly of claim 3, wherein:

the lid is disposed over the open mouth;

the pin is placed within the continuous passage;

the first set screw is placed within the second bore and in contact with the pin; and the contact point of each of the plurality of second set screws engages the housing.

6. The assembly of claim 5, in which the assembly may be placed in two configurations, wherein:

a first configuration is characterized by a force being placed on the pin by the first set screw and the second set screws engaging against the housing such that the second set screws force the housing away from the lid; and a second configuration is characterized by no force being placed on the pin by the first set screw and no force being placed on the housing by each of the plurality of set screws.

7. A method of using the assembly of claim 6, comprising:

placing the beacon into the cavity;

placing the lid over the mouth;

placing the pin into the continuous passage; and placing the assembly into the first configuration.

8. A method of joining a lid to a housing, the housing having an open mouth exposing a cavity, comprising:

placing the lid over the open mouth, wherein the lid is configured to carry a plurality of second set screws about its perimeter;

placing a pin through a first aperture in the housing, a first bore in the lid, and a second aperture in the housing, wherein the first aperture, second aperture, and first bore form a continuous passage when the lid is placed over the open mouth;

placing a first set screw within a second bore in the lid, wherein the second bore is non-parallel to and intersecting with the first bore;

placing a force on the pin with an end of the first set screw; and adjusting the plurality of second set screws such that the plurality of second set screws engages against the housing when the lid is covering the open mouth such that the lid is pushed away from the housing.

9. The method of claim 8 in which the plurality of second set screws are configured to contact a plurality of depressions formed within the housing.

10. The method of claim 8 wherein the step of placing the first set screw into the second bore is performed after placing the pin into the first bore.

11. The method of claim 8 wherein the force applied on the pin with the set screw pushes the lid away from the housing.

12. A method comprising:

placing a beacon into a cavity in an elongate housing through an open mouth;

covering the open mouth with a lid;

securing the lid to the elongate housing with a component; and thereafter, placing a set screw into the lid such that placement of the set screw applies a force to the component.

13. The method of claim 12 in which the component comprises a crossbolt, wherein the step of securing the lid to the elongate housing comprises placing the crossbolt through a tab of the lid in a first direction.

14. The method of claim 13 in which the set screw comprises a conical end, wherein the force is applied to the crossbolt at the conical end in a second direction, wherein the second direction is perpendicular to the first direction.

15. The method of claim 12 in which the component comprises a lip of the lid.

16. The method of claim 15 further comprising:

placing a crossbolt through the lid and the elongate housing; and applying a force on crossbolt by placing a set screw within the lid.

* * * * *